US008928685B2

(12) United States Patent
Kim et al.

(10) Patent No.: US 8,928,685 B2
(45) Date of Patent: Jan. 6, 2015

(54) METHOD OF DISPLAYING IMAGE AND DISPLAY APPARATUS FOR PERFORMING THE SAME

(75) Inventors: Heen-dol Kim, Yongin-si (KR); Ik-Soo Lee, Seoul (KR); Bong-Hyun You, Yongin-si (KR); Jai-Hyun Koh, Seoul (KR); Kuk-Hwan Ahn, Hwaseong-si (KR); Moon-Cheol Kim, Suwon-si (KR)

(73) Assignees: Samsung Display Co., Ltd. (KR); Korea Polytechnic University Industry-Academy Corporation Foundation (KR)

( * ) Notice: Subject to any disclaimer, the term of this patent is extended or adjusted under 35 U.S.C. 154(b) by 198 days.

(21) Appl. No.: 13/331,663

(22) Filed: Dec. 20, 2011

(65) Prior Publication Data

US 2012/0306905 A1 Dec. 6, 2012

(30) Foreign Application Priority Data

Jun. 3, 2011 (KR) ..... 10-2011-0053730

(51) Int. Cl.
*G09G 5/02* (2006.01)

(52) U.S. Cl.
CPC ..... *G09G 5/02* (2013.01)
USPC ..... 345/590; 345/604

(58) Field of Classification Search
CPC ..... G09G 2320/0633; G09G 2330/021; G09G 2360/16; G09G 2320/0646; G09G 3/3406; G09G 2320/0666; G09G 2320/0626; G09G 5/02
See application file for complete search history.

(56) References Cited

U.S. PATENT DOCUMENTS

| | | | | |
|---|---|---|---|---|
| 3,813,686 | A * | 5/1974 | Mierzwinski | 348/603 |
| 7,064,864 | B2 * | 6/2006 | Takahashi et al. | 358/1.9 |
| 7,075,242 | B2 * | 7/2006 | Miller et al. | 315/169.3 |
| 7,271,812 | B2 * | 9/2007 | Van Dyke et al. | 345/603 |
| 7,561,167 | B2 * | 7/2009 | Nitta et al. | 345/603 |
| 2007/0076226 | A1 * | 4/2007 | Klompenhouwer et al. | 358/1.1 |
| 2009/0085924 | A1 * | 4/2009 | Ben-Chorin et al. | 345/591 |
| 2009/0251487 | A1 * | 10/2009 | Chiang et al. | 345/604 |
| 2010/0008427 | A1 * | 1/2010 | Chiu et al. | 375/240.18 |

* cited by examiner

*Primary Examiner* — Kee M Tung
*Assistant Examiner* — Nicholas R Wilson
(74) *Attorney, Agent, or Firm* — Cantor Colburn LLP

(57) ABSTRACT

A method of processing an image signal includes: converting a source image signal into an image signal corresponding to a color space for a color gamut mapping; reducing a color gamut of the image signal; and mapping the image signal corresponding to colors within the reduced color gamut into an image signal corresponding to colors within a display color gamut, wherein the colors of the display color gamut are displayed by a display panel.

20 Claims, 9 Drawing Sheets

METHOD OF DISPLAYING IMAGE AND DISPLAY APPARATUS FOR PERFORMING THE SAME

This application claims priority to Korean Patent Application No. 2011-0053730, filed on Jun. 3, 2011, and all the benefits accruing therefrom under 35 U.S.C. §119, the content of which in its entirety is herein incorporated by reference.

BACKGROUND OF THE INVENTION

1. Field of the Invention

Exemplary embodiments of the invention relate to a method of processing an image signal and a display apparatus for performing the method of processing the image signal. More particularly, exemplary embodiments of the invention relate to a method of processing an image signal to produce a color of a high luminance, and a display apparatus for performing the method.

2. Description of the Related Art

Generally, a liquid crystal display ("LCD") apparatus includes a backlight unit and the LCD panel. The backlight unit is typically disposed under the LCD panel and includes a light source that generates white light, e.g., a fluorescence lamp or a light emitting diode ("LED"). The LCD panel includes three optical filters, such as red, green and blue color filters, which are spatially arranged, and divides a wavelength range using the three optical filters to display a primary color. The LCD apparatus display various color and luminance images by mixing the primary colors.

A color gamut for the LCD apparatus has a triangle shape connected to three primary color coordinates corresponding to three primary colors, such as general red, green and blue, in a two-dimensional color coordinate system, for example, CIE-xy chromaticity chart. The LCD apparatus using the three primary color coordinates corresponding to red, green and blue, has luminance values Yred, Ygreen and Yblue corresponding to the red, green and blue, respectively, for example, Yred [(R=1, G=0, B=0)=0.3], Ygreen [(R=0, G=1, B=0)=0.59] and Yblue [(R=0, G=0, B=1)=0.11] lower than a maximum luminance value Ywhite [(R=1, G=1, B=1)=1] corresponding to full white. Therefore, colors displayed by the LCD apparatus have luminance values lower than the maximum luminance value of the full white.

BRIEF SUMMARY OF THE INVENTION

Exemplary embodiments of the invention provide a method of processing an image signal for producing a color of a high luminance.

Exemplary embodiments of the invention also provide a display apparatus for performing the method of processing the image signal.

According to an exemplary embodiment of the invention, a method of processing an image signal includes: converting a source image signal into an image signal corresponding to a color space for a color gamut mapping; reducing a color gamut of the image signal; and mapping the image signal corresponding to colors within the reduced color gamut into an image signal corresponding to colors within a display color gamut, wherein the colors of the display color gamut are displayed by a display panel.

In an exemplary embodiment, the method may further include converting the mapped image signal into an RGB image signal corresponding to the RGB color space, when the color space is not an RGB color space.

In an exemplary embodiment, the reducing the color gamut may include reducing a white level of the image signal into a level less than a white level corresponding to a white within the display color gamut.

In an exemplary embodiment, the mapping the image signal corresponding to colors within the reduced color gamut may include mapping the image signal corresponding to a color, which is within the reduced color gamut and out of the display color gamut, into the image signal corresponding to a color within the display color gamut using a clipping algorithm.

In an exemplary embodiment, the method may further include: converting the image signal into an image signal of a linear type before reducing the color gamut; and converting the mapped image signal of the linear type into an image signal of a nonlinear type.

In an exemplary embodiment, the method may further include converting the image signal of the linear type into an image signal of the linear type for display based on a color coordinate of a primary color within the display color gamut before reducing the color gamut, when the color coordinate of the primary color within the display color gamut is not a standard color coordinate.

In an exemplary embodiment, the converting the source image signal into the image signal may include converting an RGB image signal into an YCbCr image signal corresponding to a xvYCC color space, when the source image signal is the RGB image signal corresponding to an RGB color space.

In an exemplary embodiment, the mapping the image signal corresponding to the colors within the reduced color gamut into the image signal corresponding to the colors within the display color gamut may include extending a color gamut of the YCbCr image signal to a color gamut of the xvYCC color space within the display color gamut.

In an exemplary embodiment, the method may further include converting the YCbCr image signal into the RGB image signal corresponding to the RGB color space, after extending the color gamut of the YCbCr image signal.

In an exemplary embodiment, the method may further include: converting the RGB image signal into the RGB image signal of a linear type, before the converting the RGB image signal into the YCbCr image signal; and converting the RGB image signal of the linear type into the RGB image signal of a nonlinear type, after the converting the YCbCr image signal into the RGB image signal.

According to another exemplary embodiment of the invention, a display apparatus includes a display panel which displays an image, an image signal processing part and a light source part which provides light to the display panel, where the image signal processing part includes: a first color space converting part which converts a source image signal into an image signal corresponding to a color space for a color gamut mapping; a color gamut adjusting part which reduces a color gamut of the image signal; and a color gamut mapping part which maps the image signal corresponding to colors within the reduced color gamut into an image signal corresponding to colors within a display color gamut, wherein the colors within the display color gamut are displayed by the display panel.

In an exemplary embodiment, the image signal processing part may convert the mapping image signal into an RGB image signal of the RGB color space when the color space is not an RGB color space.

In an exemplary embodiment, the color gamut adjusting part may reduce a white level of the image signal into a level less than a white level corresponding to a white within the display color gamut.

In an exemplary embodiment, the display apparatus may further include a light source driving part which control the light source part such that the light having a luminance increased as much as the reduced white level of the image signal is generated.

In an exemplary embodiment, the color gamut mapping part may map the image signal corresponding to a color, which is within the reduced color gamut and out of the display color gamut among colors, into the image signal corresponding to a color within the display color gamut using a clipping algorithm.

In an exemplary embodiment, the image signal processing part may further include a first input gamma part which converts the image signal into the image signal of a linear type before the color gamut is reduced, and a first output gamma part which converts the mapped image signal of the linear type into the image signal of a nonlinear type.

In an exemplary embodiment, the source image signal may be an RGB image signal corresponding to an RGB color space, and the image signal processing part may further comprise a third color space converting part which converts the RGB image signal into an YCbCr image signal corresponding to an xvYCC color space.

In an exemplary embodiment, the image signal processing part may further include a color gamut extension part which extends a color gamut of the YCbCr image signal to a color gamut of the xvYCC color space within the display color gamut.

In an exemplary embodiment, the image signal processing part may further include a fourth color space converting part which converts the YCbCr image signal of the extended the color gamut into the RGB image signal of the RGB color.

In an exemplary embodiment, the image signal processing part may further include a second input gamma part which converts the RGB image signal into an RGB image signal of a linear type before the RGB image signal is converted into the YCbCr image signal, and a second output gamma part which converts the RGB image signal of the linear type into an RGB image signal of a nonlinear type after the YCbCr image signal is converted into the RGB image signal.

According to exemplary embodiments of the invention, the color gamut corresponding to the source image signal is reduced with respect to the display color gamut corresponding to the display panel such that the color of a high luminance may be effectively produced.

BRIEF DESCRIPTION OF THE DRAWINGS

The above and other features and aspects of the invention will become more apparent by describing in detailed exemplary embodiments thereof with reference to the accompanying drawings, in which.

DETAILED DESCRIPTION OF THE INVENTION

Figure 1:
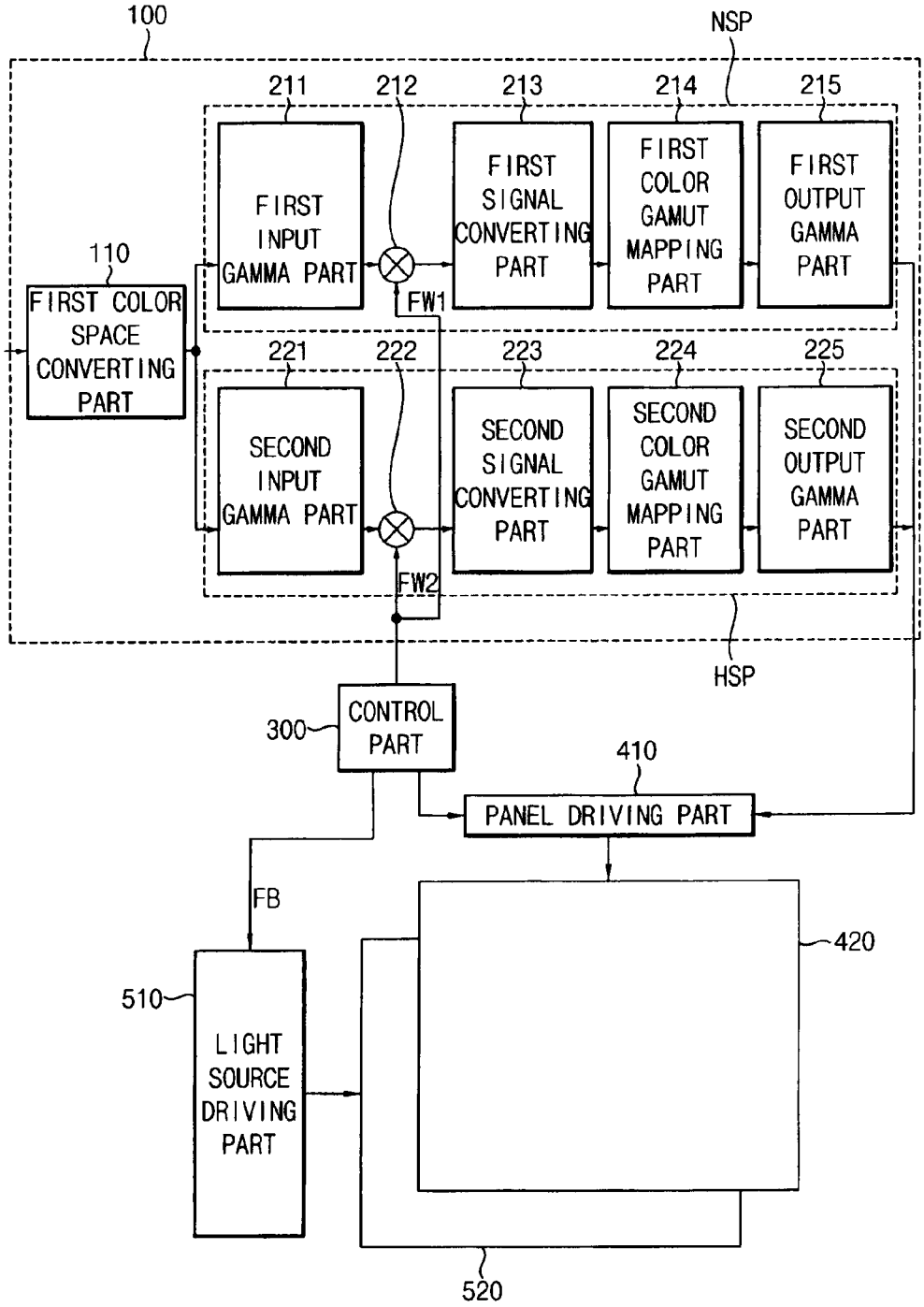
FIG. 1 is a block diagram illustrating an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be explained in detail with reference to the accompanying drawings.

FIG. 1 is a block diagram illustrating an exemplary embodiment of a display apparatus according to the invention.

Referring to FIG. 1, the display apparatus includes an image signal processing part 100, a control part 300, a panel driving part 410, a display panel 420, a light source driving part 510 and a light source part 520.

The image signal processing part 100 processes a source image signal under a low luminance color production mode or a high luminance color production mode. The source image signal may correspond to the sRGB color space, the scRGB color space, the xvYCC color space, the YCbCr color space, the CIELAB color space, the CIE-XYZ color space, CIE-xyY color space, CIERGB color space or CIELUV color space, for example.

In one exemplary embodiment, for example, the image signal processing part 100 converts the source image signal into an image signal corresponding to a color space for a color gamut mapping. The color space may be the YCbCr color space, the xvYCC color space, the CIE-xyY color space or an RGB color space, for example. The image signal processing part 100 adjusts a color gamut (source color gamut) of the source image signal under the color production mode. In the low luminance color production mode, the image signal processing part 100 adjusts the source color gamut to be substantially identical to a color gamut (display color gamut) including colors which are displayed by the display panel. In the high luminance color production mode, the image signal processing part 100 adjusts the source color gamut to be smaller than the display color gamut. The image signal processing part 100 maps an image signal corresponding to a color, which is within the source color gamut adjusted under the color production mode and out of the display color gamut, into an image signal corresponding to a color, e.g., a similar color, within the display color gamut using a color gamut mapping algorithm, such as a clipping algorithm and a color gamut expansion algorithm, for example (color gamut mapping). After the color gamut mapping, when the color space for the color gamut mapping is not the RGB color space, the mapped image signal may be converted into the image signal corresponding to the RGB color space.

The control part 300 provides first and second white coefficients FW1 and FW2 to the image signal processing part 100 to adjust the source color gamut under the color production mode. In the high luminance color production mode, the control part 300 provides a boosting coefficient FB to the light source driving part 510 such that the light source part 520 emits light having a luminance increased as much as a reduction ratio of the source color gamut. In such an embodiment, the control part 300 controls driving timings of the panel driving part 410 and the light source driving part 510.

The panel driving part 410 includes a data driving part and a gate driving part that drive the display panel 420 based on a control of the control part 300. The data driving part converts the image signal received from the image signal processing part 100 into a data voltage, and provides the data voltage to a data line of the display panel 420. The gate driving part provides a gate signal to the display panel 420 in synchronization with the data driving part.

The display panel 420 includes a plurality of pixels. Each of the pixels may include a plurality of data lines, a plurality of gate lines crossing the data lines, a plurality of switching elements electrically connected to the data lines and the gate lines, and a plurality of pixel electrodes connected to the switching elements.

The light source driving part 510 drives the light source part 520 based on a control of the control part 300. In the high luminance color production mode, the light source driving part 510 provides the boosting coefficient FB to the light source part 520. In one exemplary embodiment, for example, when the second white coefficient FW2 for adjusting the source color gamut is about ½ in the high luminance color production mode, the boosting coefficient FB may be about 2, which is a reciprocal of about ½, but the invention is not limited thereto. In an exemplary embodiment, the second white coefficient may be preset variously based on a target color gamut.

Hereinafter, the image signal processing part 100 will be described in greater detail referring to FIGS. 2 to 5.

Figure 2:
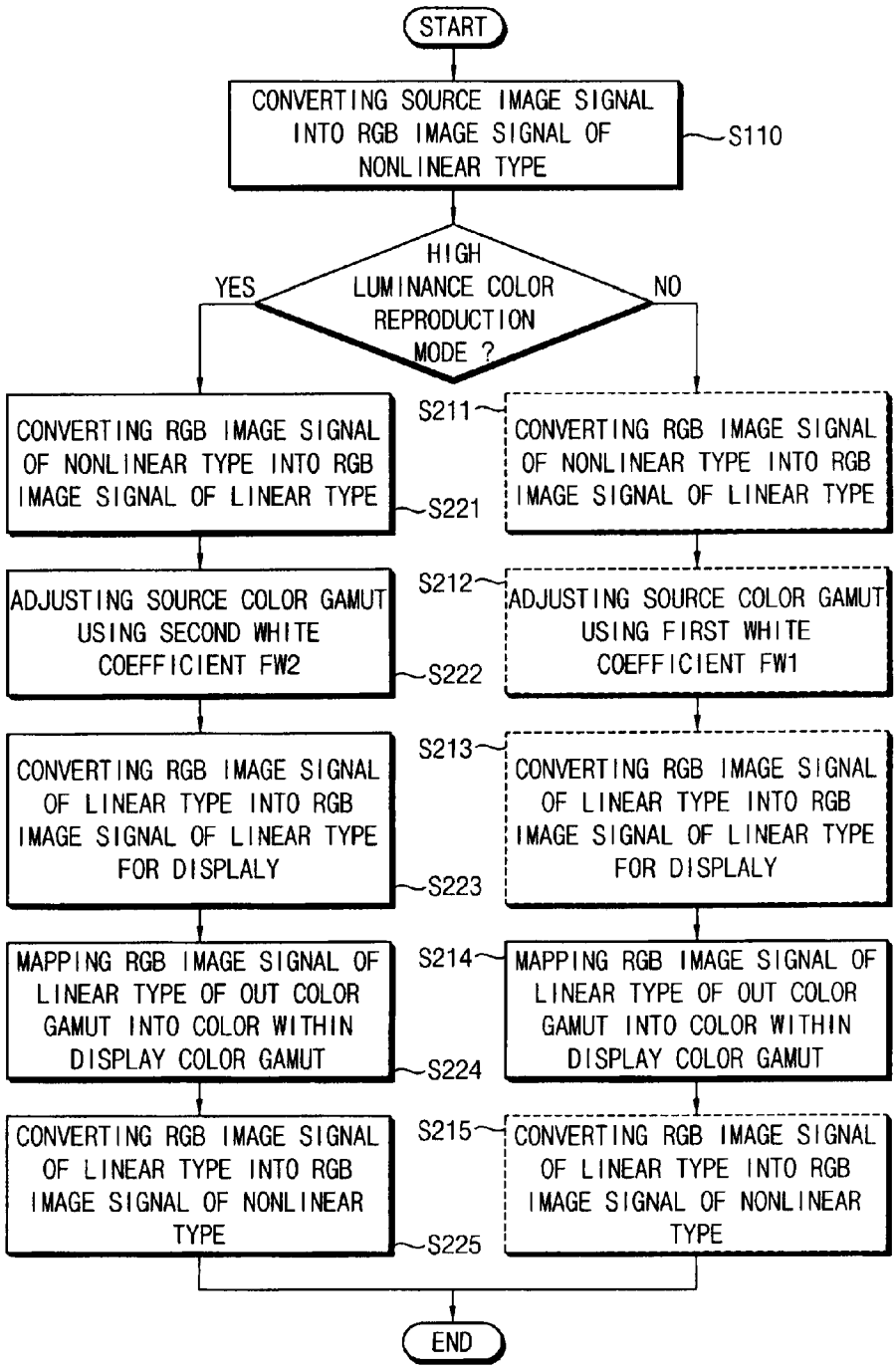
FIG. 2 is a flowchart illustrating an exemplary embodiment of a method of processing an image signal in the display apparatus in FIG. 1.
Figure 3:
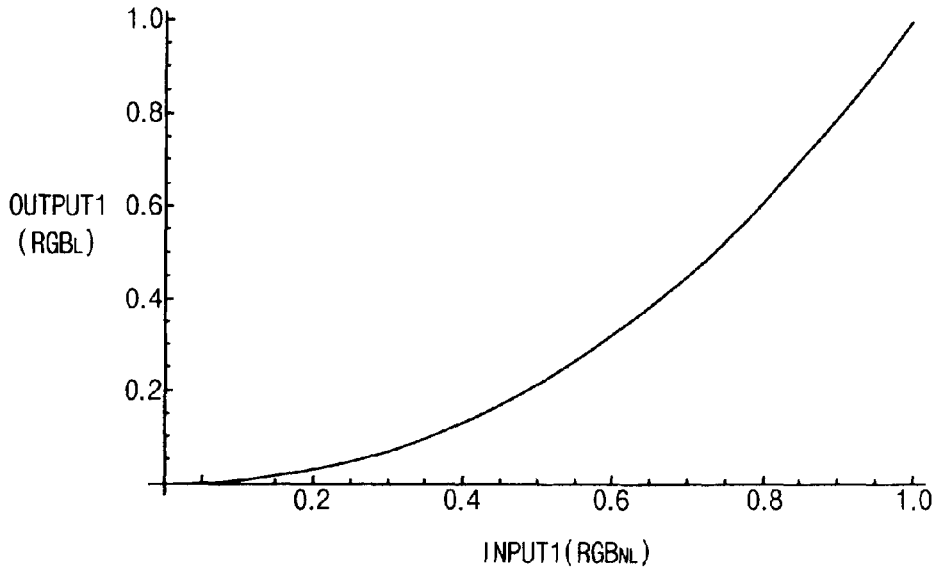
FIG. 3 is a graph illustrating a gamma curve applied to a first input gamma part in FIG. 1.
Figure 4:
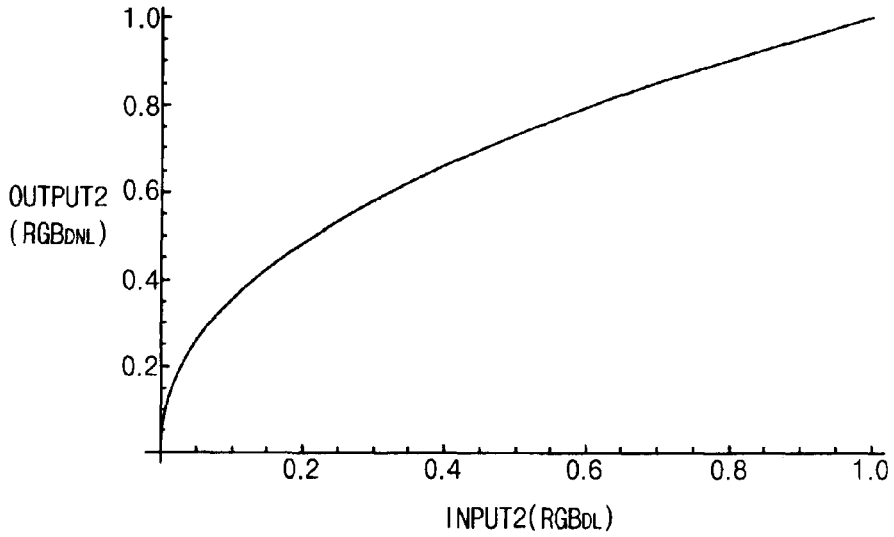
FIG. 4 is a graph illustrating a gamma curve applied to a first output gamma part in FIG. 1.
Figure 5:
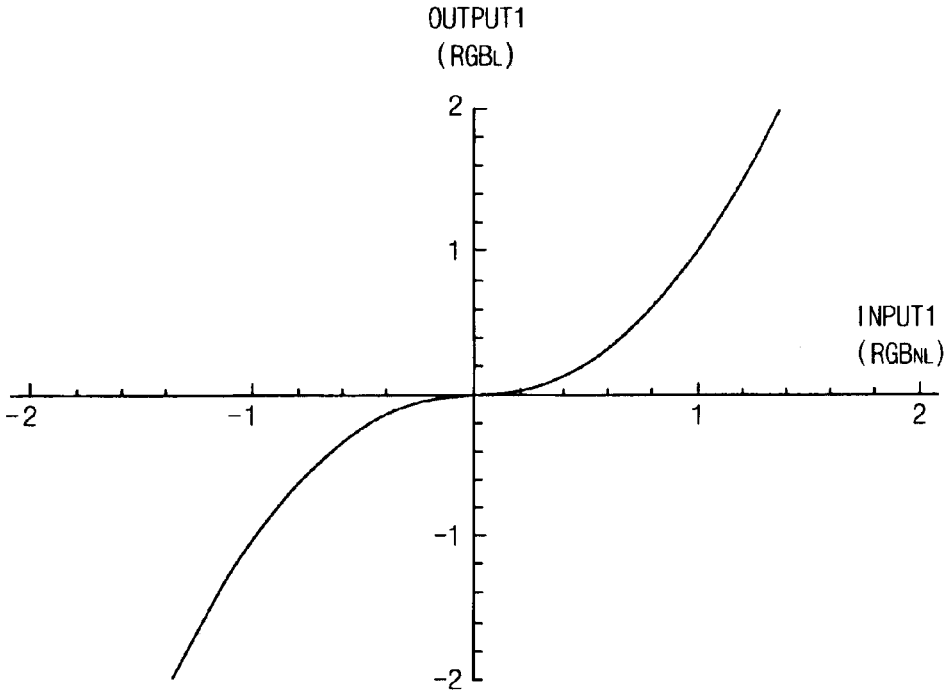
FIG. 5 is a graph illustrating a gamma curve applied to a second input gamma part in FIG. 1.

FIG. 2 is a flowchart illustrating an exemplary embodiment of a method of processing an image signal in the display apparatus in FIG. 1. FIG. 3 is a graph illustrating a gamma curve applied to a first input gamma part in FIG. 1. FIG. 4 is a graph illustrating a gamma curve applied to a first output gamma part in FIG. 1. FIG. 5 is a graph illustrating a gamma curve applied to a second input gamma part in FIG. 1.

Referring to FIGS. 1 and 2, the source image signal received in the display apparatus may be a nonlinear xvYCC image signal, a nonlinear YCbCr image signal or a nonlinear sRGB (Rec. 709) image signal.

The image signal processing part 100 includes a first color space converting part 110, a first input gamma part 211, a first color gamut adjusting part 212, a first signal converting part 213, a first color gamut mapping part 214, a first output gamma part 215, a second input gamma part 221, a second color gamut adjusting part 222, a second signal converting part 223, a second color gamut mapping part 224 and a second output gamma part 225.

The first color space converting part 110 converts the source image signal into the image signal corresponding to the color space for the color gamut mapping (step S110). In one exemplary embodiment, for example, the first color space converting part 110 converts the source image signal into red, green and blue ("RGB") image signal RGBNL of the nonlinear type corresponding to the RGB color space. The color space converting part 110 may convert the xvYCC image signal corresponding to the xvYCC color space into the RGB image signal RGBNL of the nonlinear type using the following Equation 1.

$$\begin{pmatrix} R_{NL} \\ G_{NL} \\ B_{NL} \end{pmatrix} = \begin{pmatrix} 1.0 & 0.0 & 1.14 \\ 1.0 & 0.369 & 0.581 \\ 1.0 & 2.029 & 0.0 \end{pmatrix} \cdot \begin{pmatrix} Y \\ Cb \\ Cr \end{pmatrix} \quad \text{[Equation 1]}$$

When the source image signal is within a xvYCC color gamut corresponding to the xvYCC color space, the RGB image signal RGBNL of the nonlinear type converted by the Equation 1 may have a negative value less than zero (0) or a value greater than 1 as well as values within a range of [0, 1]. When the source image signal is within a sRGB color gamut corresponding to the sRGB color space, the RGB image signal RGBNL of the nonlinear type converted by the Equation 1 may have values within a range of [0, 1]. In an exemplary embodiment, the RGB image signal within the sRGB color gamut may be a grayscale signal of 8 Bits in a range of [0, 255], and the RGB image signal may be normalized to be in the range of [0, 1].

The first color space converting part 110 provides the RGB image signal RGBNL of the nonlinear type to a low luminance color production signal processing part NSP or a high luminance color production signal processing part HSP based on the control of the control part 300 under the color production mode.

In the low luminance color production mode, the first input gamma part 211 converts the RGB image signal RGBNL of the nonlinear type received from the first color space converting part 110 into an RGB image signal RGBL of the linear type (step S211). Referring to FIG. 3, the first input gamma part 211 receives the RGB image signal RGBNL of the nonlinear type (INPUT1). The first input gamma part 211 applies a preset gamma curve, for example, a 2.2-gamma curve, to the RGB image signal RGBNL of the nonlinear type, to output the RGB image signal RGBL of the linear type (OUTPUT1).

The first color gamut adjusting part 212 adjusts the source color gamut of the RGB image signal RGBL of the linear type with respect to the display color gamut using the first white coefficient FW1 received from the control part 300 (step S212). In one exemplary embodiment, for example, when the first white coefficient FW1 of 1 is applied to the white level of the RGB image signal RGBL of the linear type, the source color gamut of the RGB image signal RGBL has a white level substantially equal to a white level of the display color gamut. The first white coefficient FW1 may be in a range of [0, 1].

The first signal converting part 213 converts the RGB image signal RGBL of the linear type into the RGB image signal RGBDL of the linear type for display based on a primary color coordinate corresponding to the primary color displayed on the display panel 420 (step S213). When the primary color coordinate of the display panel 420 is not identical to the primary color coordinate of a standard color space (e.g., sRGB or Rec. 709), the first signal converting part 213 converts the RGB image signal RGBL of the linear type into the RGB image signal RGBDL of the linear type for the display corresponding to the primary color coordinate of the display panel 420.

The RGB image signal RGBL of the linear type may be converted into the RGB image signal RGBDL of the linear type for display using the following Equation 2.

$$\begin{pmatrix} R_{DL} \\ G_{DL} \\ B_{DL} \end{pmatrix} = M_2^{-1} \cdot M_1 \cdot \begin{pmatrix} R_L \\ G_L \\ B_L \end{pmatrix} \quad \text{[Equation 2]}$$

In Equation 2, the first matrix M1 converts the RGB image signal RGBL of the linear type into signals corresponding to XYZ tristimulus values, and the first matrix M1 may be changed according to the standard. The second matrix M2 converts the RGB image signal RGBDL of the linear type for display into signals corresponding to the XYZ tristimulus values, and the second matrix M2 may be changed according to the primary color coordinate of the display panel.

In one exemplary embodiment, when the source image signal is within the sRGB color space, the first matrix M1 which converts the RGB image signal RGBL of the linear type into signals corresponding to the XYZ tristimulus values may be the matrix in the following Equation 3.

$$M_1 = \begin{pmatrix} 0.412424 & 0.212656 & 0.0193324 \\ 0.357579 & 0.725158 & 0.119193 \\ 0.180464 & 0.0721856 & 0.950444 \end{pmatrix} \quad \text{[Equation 3]}$$

In an exemplary embodiment, when the primary color coordinate of the display panel 420 is substantially identical to the primary color coordinate of the standard color space (e.g., sRGB or Rec. 709), the first input gamma part 211, the first color gamut adjusting part 212 and the first signal converting part 213 may be omitted.

The first color gamut mapping part 214 maps the RGB image signal RGBDL of the linear type for display received from the first signal converting part 130 into the image signals corresponding to the colors within the display color gamut of the display panel 420 (step S214). The first color gamut mapping part 214 maps the image signal among the RGB image signal RGBL of the linear type and corresponding to a color, which is out of the display color gamut under the color production mode, into the image signal corresponding to a similar color within the display color gamut using a color gamut mapping algorithm such as a clipping algorithm and a color gamut expansion algorithm, for example.

The first output gamma part 215 converts the RGB image signal RGBDL of the linear type for the display received from the first color gamut mapping part 214 into an RGB image signal RGBDNL of the nonlinear type for display (step S215). Referring to FIG. 4, the first output gamma part 215 receives the RGB image signal RGBDNL of the nonlinear type for display (INPUT2). The first output gamma part 215 applies a preset gamma curve, for example, a 4.5-gamma curve, to the RGB image signal RGBDL of the linear type for the display into the RGB image signal RGBDNL of the nonlinear type for display, and provides the RGB image signal RGBDNL of the nonlinear type for display to the panel driving part 410 (OUTPUT2).

In the high luminance color production mode, the second input gamma part 221 converts the RGB image signal RGBDNL of the nonlinear type into the RGB image signal RGBDL of the linear type (step S221). Referring to FIG. 5, the second input gamma part 221 receives the RGB image signal RGBDNL of the nonlinear type (INPUT1). The second input gamma part 221 applies a symmetry gamma curve to the RGB image signal RGBNL of the nonlinear type, to output the RGB image signal RGBL of the linear type (OUTPUT1). When the source image signal is within the sRGB color gamut, the RGB image signal RGBNL of the nonlinear type is within a range of [0, 1]. However, when the source image signal is the color within the xvYCC color gamut, the RGB image signal RGBNL of the nonlinear type may have a negative value and a value greater than 1 as well as values within the range of [0, 1]. In the high luminance color production mode, the color which is out of the range of [0, 1] may be displayed. Thus, the second input gamma part 221 applies the symmetry gamma curve to the RGB image signal RGBNL of the nonlinear type such that the RGB image signal RGBL of the linear type corresponding to an entire range may be outputted.

The second color gamut adjusting part 222 reduces the source color gamut corresponding to the RGB image signal RGBL of the linear type with respect to the display color gamut using the second white coefficient FW2 received from the control part 300 (step S222). The second white coefficient FW2 may be in a range of [0, 1]. In one exemplary embodiment, for example, the second color gamut adjusting part 222 applies the second white coefficient FW2 of 0.5 to the white level of the RGB image signal RGBL such that the source color gamut corresponding to the RGB image signal RGBL of the linear type is reduced by about ½ with respect to the white level of the display color gamut. All color levels of corresponding to the RGB image signal RGBL are reduced by the same reduced ratio as the white level of the RGB image signal RGBL reduced by the second white coefficient FW2. Therefore, the source color gamut may be reduced by about ½, which is the value of the second white coefficient FW2, with respect to the display color gamut.

The second signal converting part 223 converts the RGB image signal RGBL of the linear type into the RGB image signal RGBDL of the linear type for display based on the primary color coordinate of the display panel 420 (step S223). When the primary color coordinate of the display panel 420 is substantially identical to the primary color coordinate of the standard color space (e.g., sRGB or Rec. 709), the second signal converting part 223 may be omitted. In one exemplary embodiment, for example, where the primary color coordinate of the display panel 420 is substantially identical to the primary color coordinate of the standard color space sRGB, the second signal converting part 223 may be omitted. In an alternative exemplary embodiment, where the primary color coordinate of the display panel 420 is not identical to the primary color coordinate of the standard color space sRGB, the RGB image signal RGBL of the linear type may be converted into the RGB image signal RGBDL of the linear type for display by the second signal converting part 223.

The second color gamut mapping part 224 maps the RGB image signal RGBDL of the linear type for display received from the second signal converting part 223 into the display color gamut of the display panel 420 (step S224). The second color gamut mapping part 224 maps the image signal corresponding to a color, which is out of the display color gamut and among colors corresponding to the RGB image signal RGBDL of the linear type, into the image signal corresponding to a similar color within the display color gamut using the color gamut mapping algorithm such as the clipping algorithm, the color gamut expansion algorithm, etc.

The second output gamma part 225 converts the RGB image signal RGBDL of the linear type for display received from the second color gamut mapping part 224 into the RGB image signal RGBDNL of the nonlinear type for display (step S225). Referring again to FIG. 4, the second output gamma part 225 receives the RGB image signal RGBDL of the linear type (INPUT2). The second output gamma part 225 applies a preset gamma curve, for example, the 4.5-gamma curve to the RGB image signal RGBDL of the linear type for display into the RGB image signal RGBDNL of the nonlinear type for display, and outputs the RGB image signal RGBDNL of the nonlinear type for display to the panel driving part 410 (OUTPUT2).

In an alternative exemplary embodiment, where the color gamut mapping is performed in the color space different from the RGB color space, the image signal processing part 100 may include a second color space converting part (not shown) which converts the color space of the image signal into the RGB color space, after the color gamut mapping. In one exemplary embodiment, for example, the image signal processing part 100 may include the second color space converting part disposed next to each of the first and second color gamut mapping parts 214 and 224.

Figure 6:
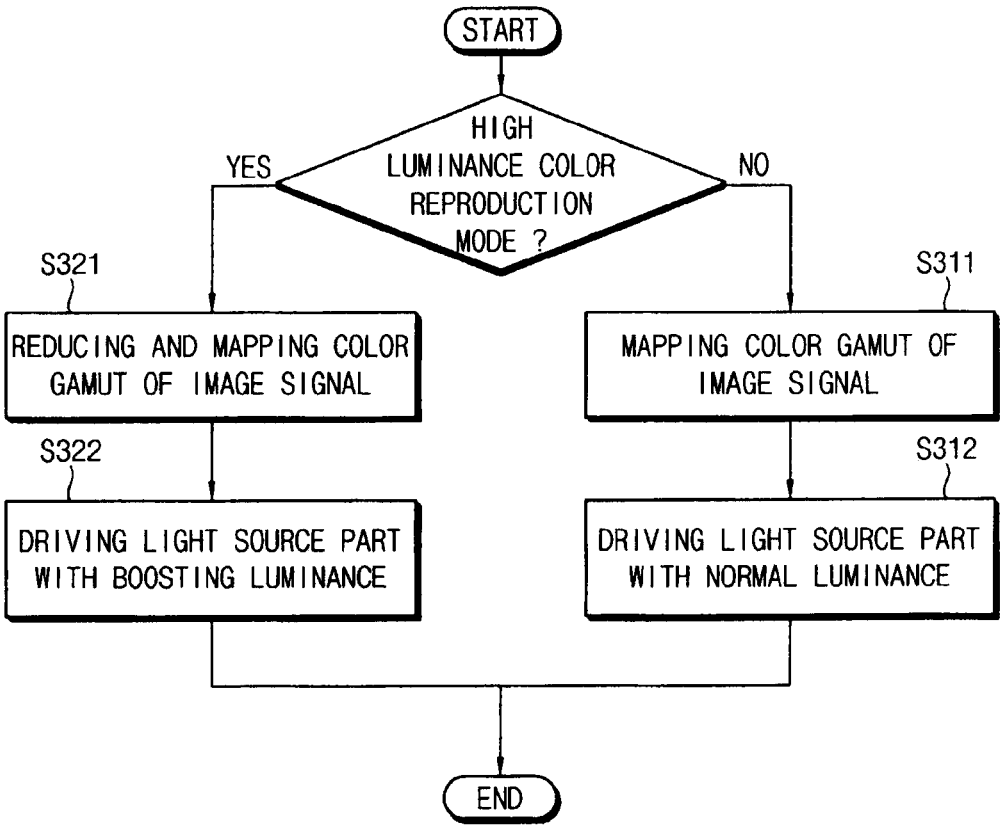
FIG. 6 is a flowchart illustrating an exemplary embodiment of a method of displaying an image in the display apparatus in FIG. 1.
Figure 7:
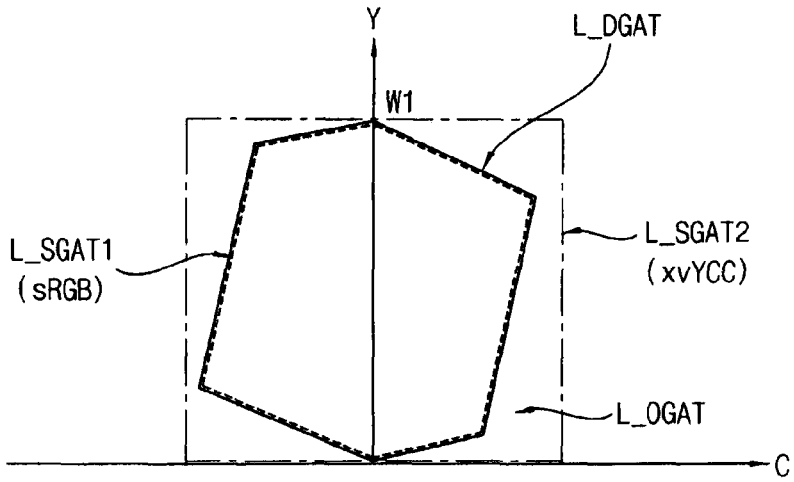
FIG. 7 is a graph illustrating a color gamut mapping in an YCbCr color space of a linear type under a low luminance color production mode of the display apparatus in FIG. 1.
Figure 8:
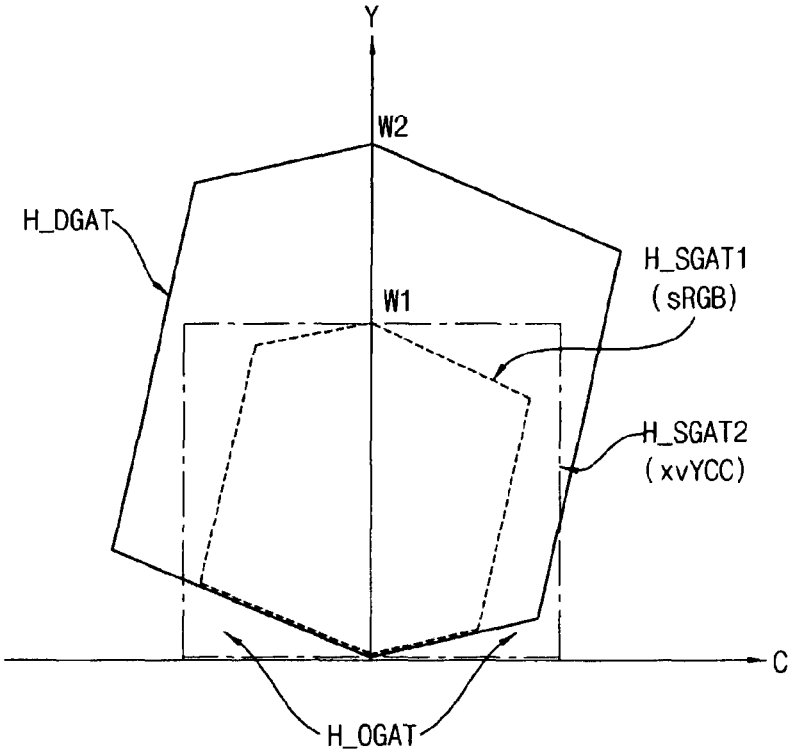
FIG. 8 is a graph illustrating a color gamut mapping in the YCbCr color space of the linear type under a high luminance color production mode of the display apparatus in FIG. 1.

FIG. 6 is a flowchart illustrating an exemplary embodiment of a method of displaying an image in the display apparatus in FIG. 1. FIG. 7 is a graph illustrating a color gamut mapping in an YCbCr color space of a linear type under a low luminance color production mode of the display apparatus in FIG. 1. FIG. 8 is a graph illustrating a color gamut mapping in the YCbCr color space of the linear type under a high luminance color production mode of the display apparatus in FIG. 1.

Hereinafter, an exemplary embodiment of a method of displaying the image in the low luminance color production mode will be described referring to FIGS. 1 and 6.

The image signal processing part 100 converts the source image signal into the image signal corresponding to the color space for the color gamut mapping. In one exemplary embodiment, for example, when the color gamut mapping is performed in the YCbCr color space of the linear type, the image signal processing part 110 converts the source image signal into the YCbCr image signal corresponding to the YCbCr color space of the linear type, applies the first white coefficient (e.g., FW1=1) to the YCbCr image signal to adjust the source color gamut corresponding to the YCbC image signal and performs the color gamut mapping in the YCbCr color space of the linear type (step S311). The light source driving part 510 drives the light source part 520 such that a peak luminance level of the light generated from the light source part 520 have a first luminance level which is normal (step S312).

Referring to FIG. 7, the display panel 420 has a display color gamut L_DGAT including a first white level W1 based on light of the first luminance level generated from the light source part 520.

In an exemplary embodiment, where the source image signal is the sRGB image signal corresponding to the sRGB color space, a source color gamut L_SGAT1 of the image signal processed from the image signal processing part 100 is substantially the same as the display color gamut L_DGAT. In such an embodiment, the image signal processing part 100 may not perform the color gamut mapping.

In an exemplary embodiment, where the source image signal is the xvYCC image signal corresponding to the xvYCC color space, a source color gamut L_SGAT2 of the image signal processed from the image signal processing part 100 includes an out color gamut L_OGAT that is out of the display color gamut L_DGAT. In such an embodiment, the image signal processing part 100 maps the image signal corresponding to a color within the out color gamut L_OGAT into the image signal corresponding to a similar color within the display color gamut L_DGAT using the color gamut mapping algorithm, such as the clipping algorithm and the color gamut expansion algorithm, for example.

After the color gamut mapping, the image signal processing part 100 converts the image signal corresponding to the YCbCr color space into the image signal corresponding to the RGB color space.

Hereinafter, an exemplary embodiment of a method of displaying the image in the high luminance color production mode will be described.

The image signal processing part 100 converts the source image signal into, for example, the YCbCr image signal corresponding to the YCbCr color space of the linear type for the color gamut mapping, applies the second white coefficient (e.g., FW2<1) to the YCbCr image signals to reduce the source color gamut corresponding to the YCbCr image signal, and performs the color gamut mapping in the YCbCr color space of the linear type (step S321). The light source driving part 510 drives the light source part 520 in response to the boosting coefficient (FB=1/FW2) such that the peak luminance level of the light generated from the light source part 520 is boosted up to a second luminance level higher than the first luminance level (step S322).

Referring to FIG. 8, the display panel 420 has the display color gamut H_DGAT including a second luminance level W2 higher than the first white level W1 in FIG. 7 based on the light of the second luminance level boosted up from the light source part 520. Thus, the display color gamut H_DGAT may be extended from the display color gamut L_DGAT in FIG. 7.

When the source image signal is the sRGB image signal corresponding to the sRGB color space, the source color gamut H_SGAT1 of the image signal processed from the image signal processing part 100 has the first white level W1 reduced by the second white coefficient (FW2=W1/W2) with respect to a second white level W2 of the display color gamut H_DGAT. Thus, the source color gamut H_SGAT1 is entirely reduced by the second white coefficient (FW2=W1/W2) with respect to the display color gamut H_DGAT. The source color gamut H_SGAT1 is included within the display color gamut H_DGAT such that the image signal processing part 100 may not perform the color gamut mapping.

When the source image signal is the xvYCC signal corresponding to the xvYCC color space, the source color gamut H_SGAT2 of the image signal processed from the image signal processing part 100 has the first white level W1 reduced by the second white coefficient (FW2=W1/W2) with respect to the second white level W2 of the display color gamut H_DGAT. Thus, the source color gamut H_SGAT2 is entirely reduced by the second white coefficient (FW2=W1/W2) with respect to the display color gamut H_DGAT. In an exemplary embodiment, the source color gamut H_SGAT2 includes an out color gamut H_OGAT, which is out of the display color gamut H_DGAT, and the image signal processing part 100 maps the image signal corresponding to a color within the out color gamut H_OGAT into the image signal corresponding to a similar color within the display color gamut H_DGAT using the color gamut mapping algorithm, such as the clipping algorithm and the color gamut expansion algorithm, for example.

After the color gamut mapping, the image signal processing part 100 converts the image signal corresponding to the YCbCr color space of the linear type into the image signal corresponding to the RGB color space.

Referring to FIGS. 7 and 8, in the high luminance color production mode, the source color gamut of the image signal is reduced, and the luminance of the light is boosted up in synchronization therewith, such that the out color gamut H_OGAT may be decreased compared with the out color gamut L_OGAT in the low luminance color production mode. Therefore, in the high luminance color production mode, the display apparatus may produce the color of a high luminance.

Figure 9:
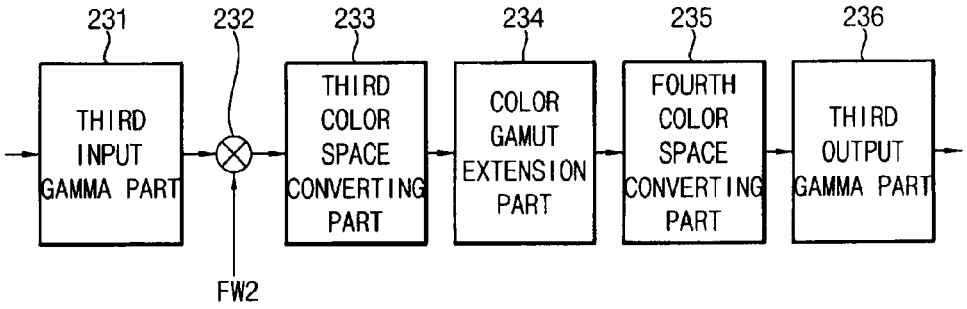
FIG. 9 is a block diagram illustrating an alternative exemplary embodiment of an image signal processing part according to the invention.
Figure 10:
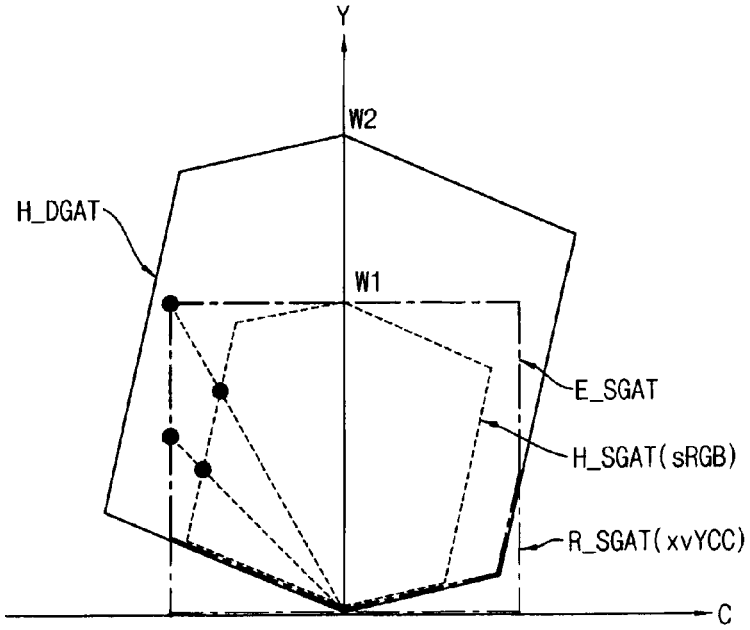
FIG. 10 is a graph illustrating a color gamut mapping in the YCbCr color space of the linear type under a high luminance color production mode of the image signal processing part in FIG. 9.

FIG. 9 is a block diagram illustrating an alternative exemplary embodiment of an image signal processing part according to the invention. FIG. 10 is a graph illustrating a color gamut mapping in the YCbCr color space of the linear type under a high luminance color production mode of the image signal processing part in FIG. 9.

In the illustrated exemplary embodiment, the display apparatus is substantially the same as the exemplary embodiment described in FIG. 1 expect for the method of processing the source image signal, which is the sRGB image signal corresponding to the sRGB color space. Hereinafter, the same reference numerals will be used to refer to the same or like parts as those described in the example embodiment in FIG. 1, and any repetitive detailed description thereof will be omitted or simplified.

Referring to FIGS. 1, 9 and 10, the display apparatus includes a third input gamma part 231, a third color gamut adjusting part 232, a third color space converting part 233, a color gamut extension part 234, a fourth color space converting part 235 and a third output gamma part 236.

The third input gamma part 231 converts the RGB image signal RGBNL of the nonlinear type into the RGB image signal RGBL of the linear type. In one exemplary embodiment, for example, the third input gamma part 231 applies the 2.2-gamma curve to the RGB image signal RGBNL of the nonlinear type to convert the RGB image signal RGBNL of the nonlinear type into the RGB image signal RGBL of the linear type.

The third color gamut adjusting part 232 reduces the white level of the RGB image signal RGBL using the second white coefficient (FW2=W1/W2) received from the control part 300. The second white coefficient FW2 may have a range of [0, 1], for example, 0.5. In such an embodiment, the light source part 520 may generate light of the high luminance boosted up based on the boosting coefficient (FB=W2/W1) which is a reciprocal of the second white coefficient (FW2=W1/W2).

The third color space converting part 233 converts the RGB image signal RGBL of the linear type corresponding to the RGB color space into the YCbCr image signal YCbCrL of the linear type corresponding to the YCbCr color space for the color gamut mapping. The following Equation 4 may be used for converting the RGB image signal RGBL of the linear type into the YCbCr image signal YCbCrL of the linear type.

$$\begin{pmatrix} Y_L \\ Cb_L \\ Cr_L \end{pmatrix} = \begin{pmatrix} 0.2126 & 0.7152 & 0.0722 \\ -0.115 & -0.385 & 0.5 \\ 0.5 & -0454 & -0.046 \end{pmatrix} \begin{pmatrix} R_L \\ G_L \\ B_L \end{pmatrix} \quad \text{[Equation 4]}$$

The YCbCr image signal YCbCrL of the linear type is different from the YCbCr image signal of the nonlinear type, which is a general digital television ("DTV") standard. A color image signal processed in the YCbCr color space of the linear type may decrease a hue changing effect, compared with the color image signal processed in the YCbCr color space of the nonlinear type.

The color gamut extension part 234 extends the source color gamut H_SGAT1, corresponding to the YCbCr image signal YCbCrL of the linear type, to an extension source color gamut E_SGAT. The extension source color gamut E_SGAT may correspond to the color gamut R_SGAT of the xvYCC image signal included in the display color gamut H_DGAT.

The color gamut extension part 234 extends a luminance signal Y and chrominance signals Cb and Cr to obtain an extension luminance signal Y' and extension chrominance signals Cb' and Cr' within a preset range. A normalization range of the chrominance signals Cb and Cr may be [−0.5, +0.5] and may be identical to the normalization range of the luminance signal Y. The normalization range of the luminance signal Y and the chrominance signals Cb and Cr may correspond to a range of the xvYCC color gamut R_SGAT corresponding to the xvYCC image signal.

A constant k, the extension luminance signal Y' and the chrominance signals Cb' and Cr' are obtained by the following Equation 5.

$$\begin{aligned} & C = |Cb| + |Cr| \quad \text{[Equation 5]} \\ & \text{If } (Y < 0.5) \quad k = 1 + (C/0.6) \\ & \text{else} \quad k = 1 + (C/0.6 + 2.5 * (2 * Y - 1) \\ & (Y', Cb', Cr') = k \cdot (Y, Cb, Cr) \end{aligned}$$

Referring to Equation 5 above, the color gamut extension part 234 obtains a chroma signal C using the luminance signal Y and the chrominance signals Cb and Cr of the YCbCr image signal YCbCrL of the linear type and obtains the constant k based on the chroma signal C. Each of the luminance signal Y and the chrominance signals Cb and Cr is multiplied by the constant k such that the extension luminance signal Y' and the extension chrominance signals Cb' and Cr' are obtained.

In an alternative exemplary embodiment, the chroma signal C may be obtained using $\sqrt{Cb^2+Cr^2}$ instead of a method using an absolute value as shown in Equation 5. Referring to Equation 5, the constant k may be extended to two times when the luminance signal Y is less than 0.5. However, when the luminance signal Y is greater than 0.5, an extension range of the constant k may be decreased as the luminance signal Y is increased.

When the extension luminance signal Y' is not within a threshold range, the extension luminance signal Y' and the extension chrominance signals Cb' and Cr' may be reduced and corrected using the following Equation 6.

$$\begin{aligned} & \text{If } (Y')1)\{ \quad \text{[Equation 6]} \\ & \quad g = 1.0/Y' \\ & \quad Y'' = 1.0 \leftarrow \\ & \quad (Cb'', Cr'') = g \cdot (Cb', Cr') \\ & \} \\ & \text{else } \{ \\ & \quad Y'' = Y' \\ & \quad Cb'' = Cb' \\ & \quad Cr'' = Cr' \\ & \} \end{aligned}$$

In Equation 6, Y" denotes the corrected extension luminance signal, and Cb" and Cr" denote the corrected extension chrominance signals.

The fourth color space converting part 235 converts the YCbCr image signal YCbCrL of the linear type corresponding to the YCbCr color space into the RGB image signal RGBL of the linear type corresponding to the RGB color space. The YCbCr image signal YCbCrL of the linear type is multiplied by a reverse matrix of the matrix in Equation 4 to convert the YCbCr image signal YCbCrL of the linear type into the RGB image signal RGBL of the linear type.

The third output gamma part 236 converts the RGB image signal RGBL of the linear type into the RGB image signal RGBNL of the nonlinear type. In one exemplary embodiment, for example, the third output gamma part 236 applies the 4.5-gamma curve to the RGB image signal RGBL of the linear type to convert the RGB image signal RGBL of the linear type into the RGB image signal RGBNL of the nonlinear type. The RGB image signal RGBNL of the nonlinear type may be provided to the panel driving part 410.

Figure 11:
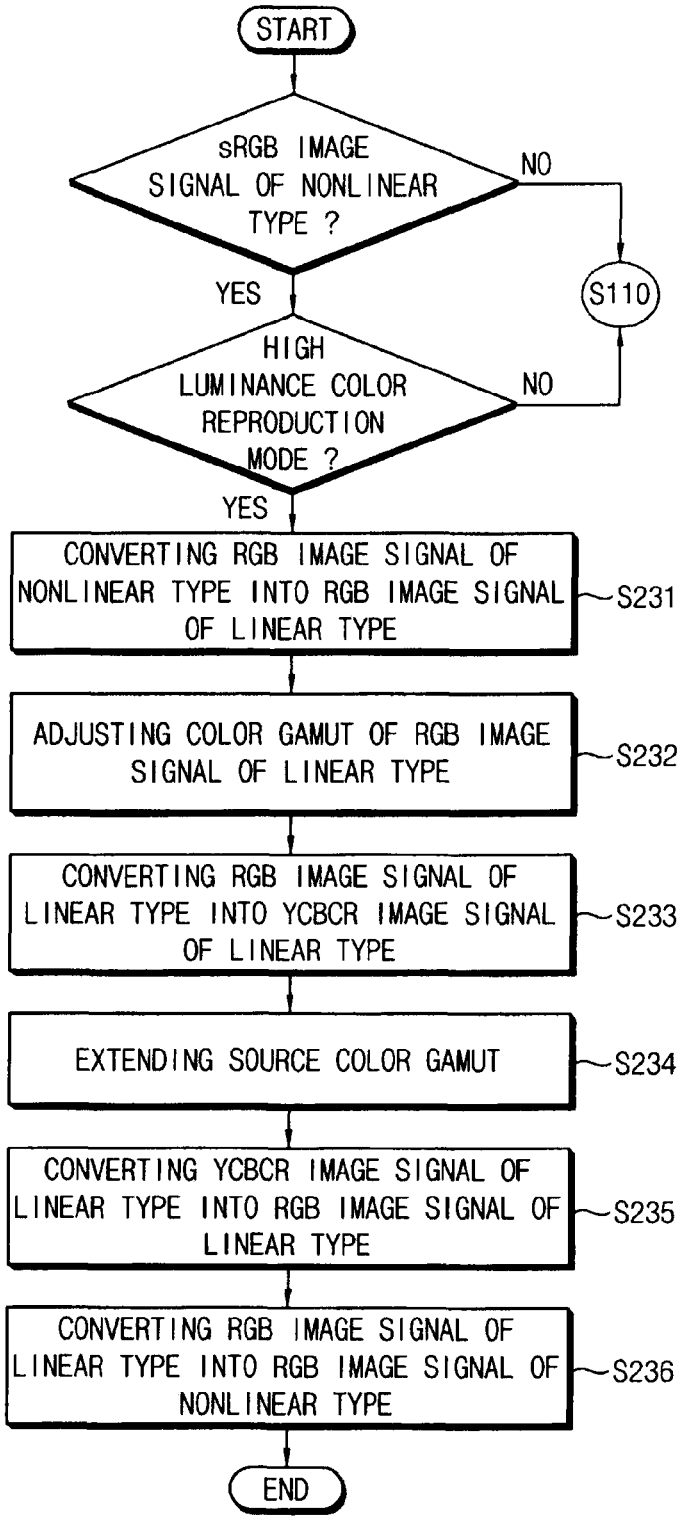
FIG. 11 is a flowchart illustrating an exemplary embodiment of a method of processing an image signal in the image signal processing part in FIG. 9.

The exemplary embodiment of the display apparatus described referring to FIGS. 1, 9 and 10 may be substantially the same as the exemplary embodiment descried referring to FIGS. 1 to 8 expect for the method of processing the image signal in the high luminance color production mode when the source image signal is the sRGB image signal corresponding to FIG. 11 is a flowchart illustrating an exemplary embodiment of a method of processing an image signal in the image signal processing part in FIG. 9;

Referring to FIGS. 8, 9, 10 and 11, an exemplary embodiment of a method of processing the image signal when the source image signal is the sRGB image signal of the nonlinear type in the high luminance color production mode will be described.

The third input gamma part 231 converts the RGB image signal RGBNL of the nonlinear type into the RGB image signal RGBL of the linear type (step S231).

The third color gamut adjusting part 232 reduces the source color gamut corresponding to the RGB image signal RGBL of the linear type with respect to the display color gamut of the display panel 420 based on the second white coefficient FW2 (step S232). The second white coefficient FW2 is for adjusting the white level of the RGB image signal RGBL to be lower than the white level of the display color gamut of the display panel 420. The second white coefficient FW2 may be in a range of [0, 1], for example, 0.5. All color levels of corresponding to the RGB image signal RGBL are reduced at a same reduced rate as the white level of the RGB image signal RGBL reduced by the second white coefficient FW2.

The third color space converting part 233 converts the RGB image signal RGBL of the linear type into the YCbCr signal YCbCrL of the linear type (step S233). The YCbCr image signal YCbCrL of the linear type is different from the YCbCr image signal of the nonlinear type, which is a general DTV standard. A color image signal processed in the YCbCr color space of the linear type may decrease a hue changing effect, compared with the color image signal processed in the YCbCr color space of the nonlinear type.

The color gamut extension part 234 extends the source color gamut H_SGAT1 corresponding to the YCbCr image signal YCbCrL of the linear type to an extension source color gamut E_SGAT corresponding to the color gamut of the xvYCC image signal included in the display color gamut H_DGAT (step S234).

The fourth color space converting part 235 converts the YCbCr image signal YCbCrL of the linear type corresponding to the YCbCr color space into the RGB image signal RGBL of the linear type corresponding to the RGB color space (step S235).

The third output gamma part 236 converts the RGB image signal RGBL of the linear type into the RGB image signal RGBNL of the nonlinear type and provides the RGB image signal RGBNL of the nonlinear type to the panel driving part 410 (step S236).

The exemplary embodiment of the display apparatus described referring to FIGS. 8, 9, 10 and 11 may be substantially the same as the exemplary embodiment descried referring to FIGS. 1 to 8 expect for the method of processing the image signal in the high luminance color production mode when the source image signal is the sRGB image signal corresponding to sRGB color space.

According to the illustrated exemplary embodiment, when the source image signal is the sRGB image signal of the nonlinear type, the colors within the color gamut may be substantially extended using the color gamut extension algorithm in the high luminance color production mode.

Figure 12:
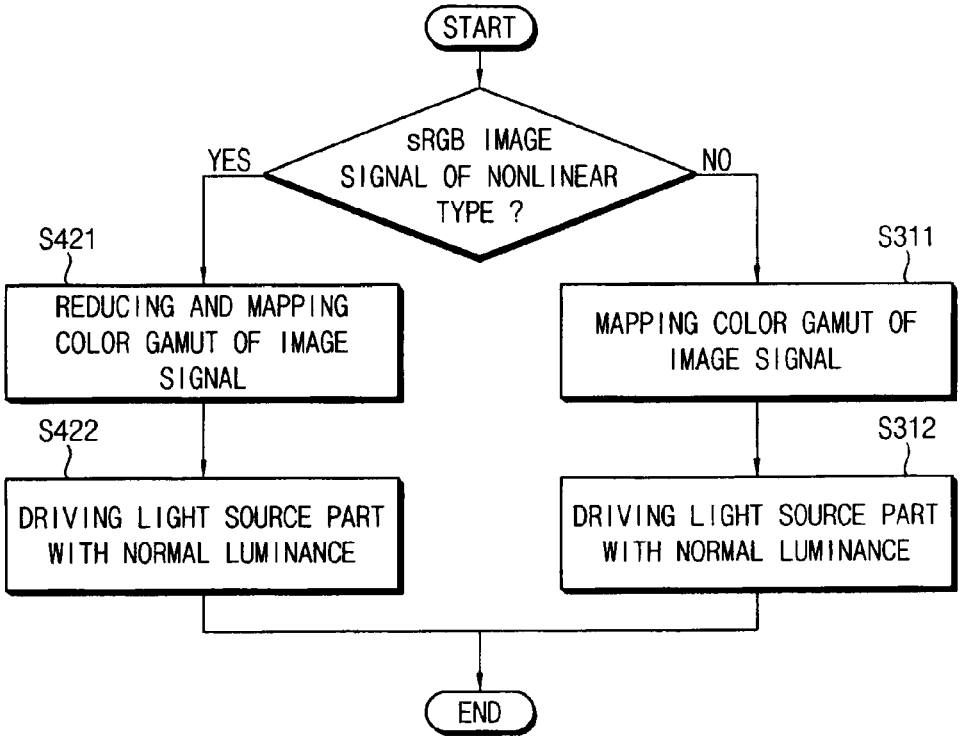
FIG. 12 is a flowchart illustrating an alternative exemplary embodiment of a method of displaying an image according to the invention.
Figure 13:
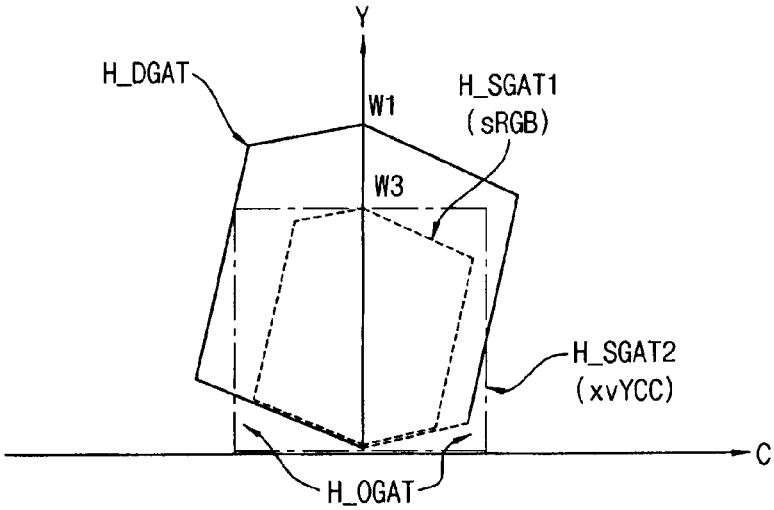
FIG. 13 is a graph illustrating a color gamut mapping in the linear YCbCr color space under a high luminance color production mode in the method of displaying the image of FIG. 12.

FIG. 12 is a flowchart illustrating another alternative exemplary embodiment of a method of displaying an image according to the invention. FIG. 13 is a graph illustrating a color gamut mapping in the linear YCbCr color space under a high luminance color production mode in the method of displaying the image of FIG. 12.

The exemplary embodiment of the display apparatus using the method in FIG. 12 is substantially the same as the exemplary embodiment descried referring to FIG. 1 expect for the method of processing the image signal in the high luminance color production mode. Hereinafter, the same reference numerals will be used to refer to the same or like parts as those described in the example embodiment in FIGS. 1 to 11, and any repetitive detailed explanation will be omitted.

Referring to FIGS. 1 and 12, the method of processing the image signal in the low luminance color production mode is substantially the same as the exemplary embodiment of the method descried referring to FIGS. 6 and 7, and any repetitive detailed description thereof will be omitted.

The method of processing the image signal in the high luminance color production mode will now be described.

The image signal processing part 100 converts the source image signal into, for example, the YCbCr image signals corresponding to the YCbCr color space of the linear type for the color gamut mapping, applies the second white coefficient (FW2<1) to the YCbCr image signals to reduce the source color gamut corresponding to the YCbCr color space, and performs the color gamut mapping in the YCbCr color space of the linear type (step S421). The light source driving part 510 drives the light source part 520 such that the light source part 520 generates light having a peak luminance of the same first luminance as that in the low luminance color production mode (step S422). In one exemplary embodiment, for example, the light source part 520 is not driven to boost up the peak luminance level of the light in the high luminance color production mode.

Referring to FIG. 13, the display panel 420 has the display color gamut H_DGAT including the first white level W1 based on the light of the first luminance level generated from the light source part 520.

When the source image signal is the sRGB image signal corresponding to the sRGB color space, the source color gamut H_SGAT1 of the image signal processed from the image signal processing part 100 has a third white level W3 reduced by the second white coefficient (FW2=W1/W3) with respect to the first white level W1 of the display color gamut H_DGAT. Thus, the source color gamut H_SGAT1 is entirely reduced by the second white coefficient (FW2=W1/W3) with respect to the display color gamut H_DGAT. The source color gamut H_SGAT1 is included within the display color gamut H_DGAT such that the image signal processing part 100 may not perform the color gamut mapping.

When the source image signal is the xvYCC signal corresponding to the xvYCC color space, the source color gamut H_SGAT2 of the image signal processed from the image signal processing part 100 has the third white level W3 reduced by the second white coefficient (FW2=W1/W3) with respect to the first white level W1 of the display color gamut H_DGAT. Thus, the source color gamut H_SGAT2 is entirely reduced by the second white coefficient (FW2=W1/W3) with respect to the display color gamut H_DGAT. However, the source color gamut H_SGAT2 includes an out color gamut H_OGAT which is out of the display color gamut H_DGAT. Thus, the image signal processing part 100 maps the image signal corresponding to a color in the out color gamut H_OGAT into the image signal corresponding to a similar color within the display color gamut H_DGAT using the color gamut mapping algorithm, such as the clipping algorithm and the color gamut expansion algorithm, for example.

After the color gamut mapping, the image signal processing part 100 converts the YCbCr image signal corresponding to the YCbCr color space into the RGB image signal corresponding to the RGB color space.

In the high luminance color production mode, the third white level W3 of the source color gamut is reduced lower than the white level of the display color gamut. Thus, the out color gamut H_OGAT which is out of the display color gamut may be decreased compared with the out color gamut L_OGAT in the low luminance color production mode.

In an exemplary embodiment, although luminance of the displayed image may be decreased, the color gamut of the displayed image may be increased such that the display apparatus produces the color of the high luminance.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of displaying an image, the method comprising:

converting a source image signal into an image signal corresponding to a color space for a color gamut mapping;

adjusting a color gamut of the image signal based on a color production mode, wherein the adjusted color gamut of the image signal is substantially identical to a display color gamut when the color production mode is a low luminance color production mode, and the adjusted color gamut of the image signal is smaller than the display color gamut when the color production mode is a high luminance color production mode;

mapping the image signal corresponding to colors within the adjusted color gamut into an image signal corresponding to colors within the display color gamut, wherein the colors of the display color gamut are displayed by a display panel;

driving the display panel using the mapped image signal; and generating light to provide the display panel with the light, wherein when the color production mode is the high luminance color production mode, the color gamut of the image signal is reduced using a white coefficient and a luminance of the light is increased using a boosting coefficient which is a reciprocal of the white coefficient.

2. The method of claim 1, further comprising:

converting the mapped image signal into an RGB image signal corresponding to the RGB color space, when the color space is not an RGB color space.

3. The method of claim 1, wherein the adjusting the color gamut comprises:

reducing a white level of the image signal into a level less than a white level corresponding to a white within the display color gamut when the color production mode is the high luminance color production mode.

4. The method of claim 1, wherein the mapping the image signal corresponding to colors within the adjusted color gamut comprises:

mapping the image signal corresponding to a color, which is within the adjusted color gamut and out of the display color gamut, into the image signal corresponding to a color within the display color gamut using a clipping algorithm.

5. The method of claim 1, further comprising:

converting the image signal into an image signal of a linear type before adjusting the color gamut; and converting the mapped image signal of the linear type into an image signal of a nonlinear type.

6. The method of claim 5, further comprising:

converting the image signal of the linear type into an image signal of the linear type for display based on a color coordinate of a primary color within the display color gamut before adjusting the color gamut, when the color coordinate of the primary color within the display color gamut is not a standard color coordinate.

7. The method of claim 1, wherein the converting the source image signal into the image signal comprises:

converting an RGB image signal into an YCbCr image signal corresponding to a xvYCC color space, when the source image signal is the RGB image signal corresponding to an RGB color space.

8. The method of claim 7, wherein the mapping the image signal corresponding to the colors within the adjusted color gamut into the image signal corresponding to the colors within the display color gamut comprises:

extending a color gamut of the YCbCr image signal to a color gamut of the xvYCC color space within the display color gamut.

9. The method of claim 8, further comprising:

converting the YCbCr image signal into the RGB image signal corresponding to the RGB color space, after extending the color gamut of the YCbCr image signal.

10. The method of claim 9, further comprising:

converting the RGB image signal into the RGB image signal of a linear type, before the converting the RGB image signal into the YCbCr image signal; and converting the RGB image signal of the linear type into the RGB image signal of a nonlinear type, after the converting the YCbCr image signal into the RGB image signal.

11. A display apparatus comprising:

a display panel which displays an image;

an image signal processing part comprising:

a first color space converting part which converts a source image signal into an image signal corresponding to a color space for a color gamut mapping;

a color gamut adjusting part which adjust a color gamut of the image signal based on a color production mode, wherein the color gamut of the image signal is substantially identical to a display color gamut when the color production mode is a low luminance color production mode, and the color gamut of the image signal is smaller than the display color gamut when the color production mode is a high luminance color production mode; and a color gamut mapping part which maps the image signal corresponding to colors within the adjusted color gamut into an image signal corresponding to colors within the display color gamut, wherein the colors within the display color gamut are displayed by the display panel;

a data driving part which drives a data line of the display panel using the mapped image signal; and a light source part which provides light to the display panel, wherein when the color production mode is the high luminance color production mode, the color gamut of the image signal is reduced using a white coefficient and a luminance of the light is increased using a boosting coefficient which is a reciprocal of the white coefficient.

12. The display apparatus of claim 11, wherein the image signal processing part converts the mapped image signal into an RGB image signal of the RGB color space when the color space is not an RGB color space.

13. The display apparatus of claim 11, wherein when the color production mode is the high luminance color production mode, the color gamut adjusting part reduces a white level of the image signal into a level less than a white level corresponding to a white within the display color gamut.

14. The display apparatus of claim 13, further comprising:

a light source driving part which controls the light source part using the boosting coefficient which is the reciprocal of the white coefficient such that the light having a luminance increased as much as the reduced white level of the image signal is generated.

15. The display apparatus of claim 11, wherein the color gamut mapping part maps the image signal corresponding to a color, which is within the adjusted color gamut and out of the display color gamut among colors, into the image signal corresponding to a color within the display color gamut using a clipping algorithm.

16. The display apparatus of claim 11, wherein the image signal processing part further comprises:

a first input gamma part which converts the image signal into the image signal of a linear type before the color gamut is adjusted; and a first output gamma part which converts the mapped image signal of the linear type into a mapped image signal of a nonlinear type.

17. The display apparatus of claim 11, wherein the source image signal is an RGB image signal corresponding to an RGB color space, and the image signal processing part further comprises a third color space converting part which converts the RGB image signal into an YCbCr image signal corresponding to an xvYCC color space.

18. The display apparatus of claim 17, wherein the image signal processing part further comprises:

a color gamut extension part which extends a color gamut of the YCbCr image signal to a color gamut of the xvYCC color space within the display color gamut.

19. The display apparatus of claim 18, wherein the image signal processing part further comprises:

a fourth color space converting part which converts the YCbCr image signal of the extended the color gamut into the RGB image signal of the RGB color.

20. The display apparatus of claim 19, wherein the image signal processing part further comprises:

a second input gamma part which converts the RGB image signal into an RGB image signal of a linear type before the RGB image signal is converted into the YCbCr image signal, and a second output gamma part which converts the RGB image signal of the linear type into an RGB image signal of a nonlinear type after the YCbCr image signal is converted into the RGB image signal.

* * * * *